US009085017B2

(12) United States Patent
Liu

(10) Patent No.: US 9,085,017 B2
(45) Date of Patent: Jul. 21, 2015

(54) LENS-CLEANING DEVICE

(75) Inventor: Shang-Wei Liu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 108 days.

(21) Appl. No.: 13/600,546

(22) Filed: Aug. 31, 2012

(65) Prior Publication Data

US 2013/0117963 A1 May 16, 2013

(30) Foreign Application Priority Data

Nov. 16, 2011 (TW) ..... 100141803 A

(51) Int. Cl.
*B08B 5/02* (2006.01)
*B08B 11/02* (2006.01)

(52) U.S. Cl.
CPC ..... *B08B 5/02* (2013.01)

(58) Field of Classification Search
None
See application file for complete search history.

(56) References Cited

U.S. PATENT DOCUMENTS 5,094,609 A * 3/1992 Kindt-Larsen ..... 425/445
5,616,184 A * 4/1997 Duncan et al. ..... 134/22.1
2008/0313848 A1 * 12/2008 Zhang et al. ..... 15/405

* cited by examiner

*Primary Examiner* — Monica Carter
*Assistant Examiner* — Stephanie Berry
(74) *Attorney, Agent, or Firm* — Novak Druce Connolly Bove + Quigg LLP

(57) ABSTRACT

A lens-cleaning device for cleaning dust deposited on a plurality of lenses, includes a tray, a front cover, and a plurality of air nozzles. The tray defines a plurality of grooves and a plurality of through holes alternately arranged in a first surface of the tray. Each of the lenses is received in one groove. The front cover defines a plurality of assembling holes in a second surface of the front cover corresponding to the through holes. The front cover covers the tray with each of the air nozzles received in one assembling hole, and the air nozzles are capable of blowing air against the lenses causing the dust deposited on the outer surface of the lenses to be blown away through the through holes.

18 Claims, 3 Drawing Sheets

LENS-CLEANING DEVICE

BACKGROUND

1. Technical Field

The present disclosure relates to cleaning devices, particularly to a lens-cleaning device.

2. Description of Related Art

During the assembling of a mobile phone camera lens, dust may be deposited on the outer surface of the mobile phone camera lens. Ideally, the dust should be removed from the mobile phone camera lens before assembling the mobile phone camera lens on a mobile phone. A lens-cleaning device for cleaning the mobile phone lens typically includes an air nozzle, and the lens-cleaning device only can clean one mobile phone lens at a time. The cleaning efficiency of the mobile phone lens is relatively low, and the dust removed from one mobile phone lens may contaminate another mobile phone lens being cleaned.

Therefore, there is room for improvement in the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the lens-cleaning device. Moreover, in the drawings, like reference numerals designate corresponding parts throughout the several views. Wherever possible, the same reference numerals are used throughout the drawings to refer to the same or like elements of an embodiment.

DETAILED DESCRIPTION

Figure 1:
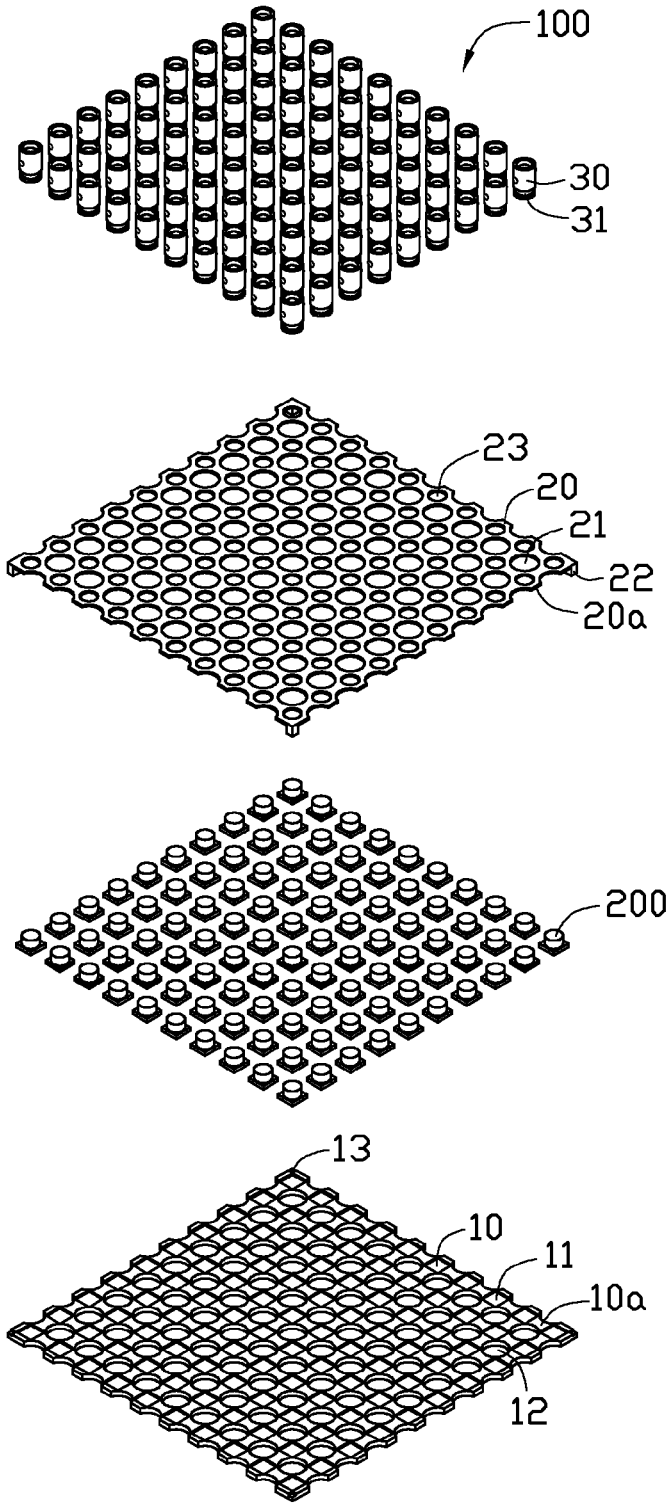
FIG. 1 is an exploded, isometric view of an embodiment of a lens-cleaning device.
Figure 2:
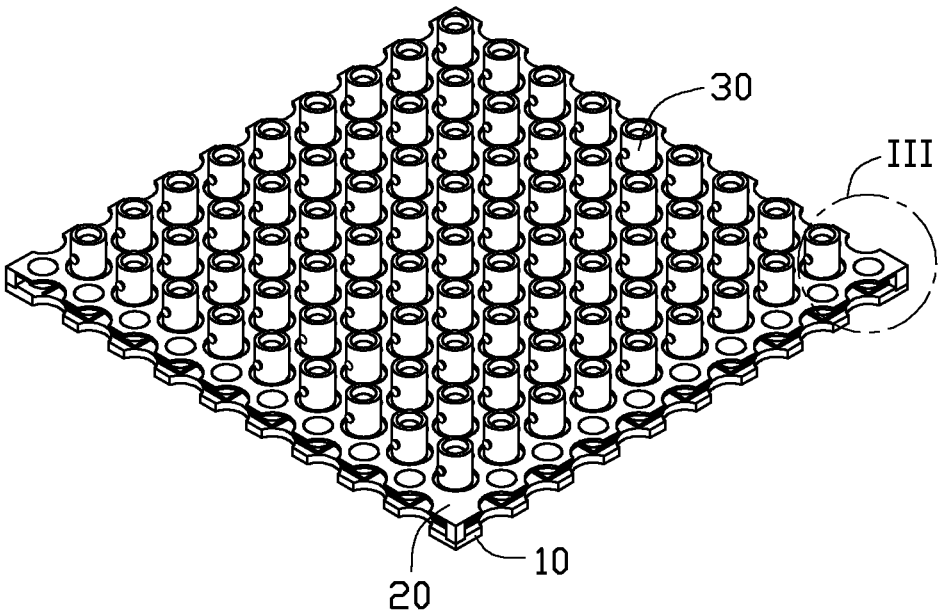
FIG. 2 is an isometric, assembled view of the lens-cleaning device of FIG. 1.

Referring to FIGS. 1 and 2, an embodiment of a lens-cleaning device 100 is shown. The lens-cleaning device 100 is used for cleaning dust deposited on a plurality of lenses 200. The lens-cleaning device 100 includes a tray 10, a front cover 20, and a plurality of air nozzles 30.

The tray 10 is a substantially rectangular board, and includes a first surface 10*a*. The tray 10 defines a plurality of grooves 11 in the first surface 10*a*. In the illustrated embodiment, the number of the grooves 11 is one hundred, and the one hundred of the grooves 11 are arranged in a matrix. Each of the grooves 11 is configured for receiving a lens 200. The tray 10 further defines a plurality of through holes 12 in the first surface 10*a*, each of the through holes 12 is located between two adjacent grooves 11, and the dust blown off from the lenses 200 can be dropped off through the through holes 12. The tray 10 further defines four locating holes 13 in four corners of the first surface 10*a*.

A shape of the front cover 20 is similar to a shape of the tray 10. The front cover 20 includes a second surface 20*a* facing the first surface 10*a* of the tray 10. The front cover 20 defines a plurality of assembling holes 21 in the second surface 20*a* corresponding to the through holes 12 of the tray 10. The front cover 20 includes four protrusions 22 substantially perpendicularly extending from four corners of the second surface 20*a* towards the first surface 10*a*. The protrusion 22 is configured to be located in one corresponding locating hole 13 to fasten the front cover 20 to the tray 10. The front cover 20 further defines a plurality of inspection holes 23 in the second surface 20*a* corresponding to the grooves 11. The lens 200 received in the groove 11 can be seen from the inspection hole 23, which can check the groove 11 whether has been loaded the lens 200.

In alternative embodiments, the number of the locating holes 13 can be two or more, and the locating holes 13 can be defined in a middle portion or other portions of the first surface 10*a*. The number of the protrusions 22 is equal to the number of the locating holes 13.

The air nozzle 30 can be a substantially hollow cylinder, and one air nozzle 30 is received in one corresponding assembling hole 21. Each air nozzle 30 defines a gas outlet 31 in the side wall of the air nozzle 30. The air nozzle 30 blows air against an outer surface of the lens 20 through the gas outlet 31. In alternative embodiments, the air nozzle 30 can be shaped as a hollow block, or hollow strip, for example, the gas outlet 31 can be axially defined at an end of the air nozzle 30 towards the tray 10.

Figure 3:
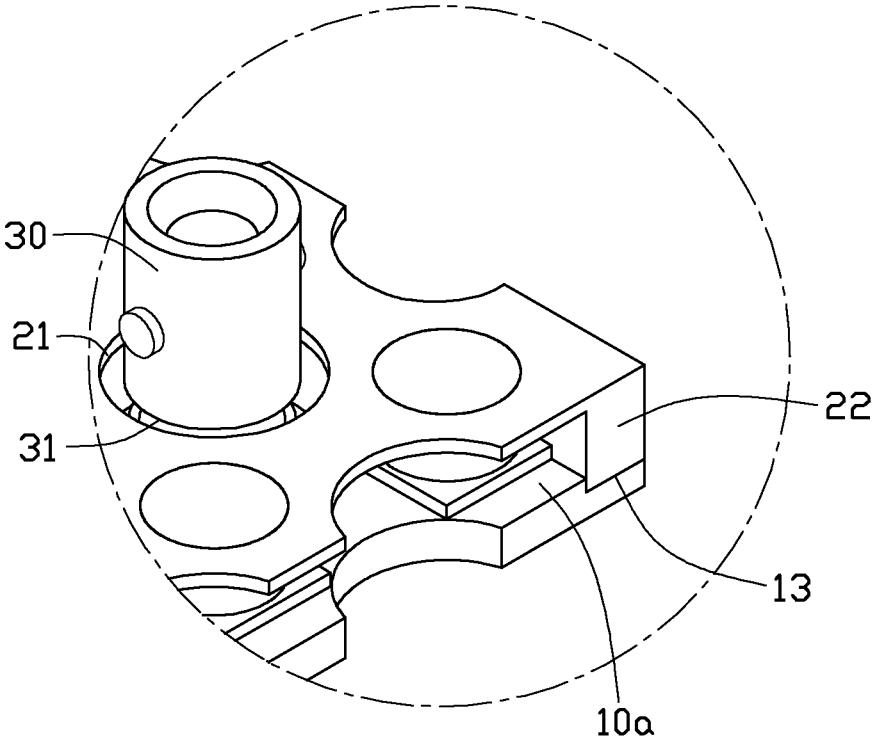
FIG. 3 is an enlarged view of a circled portion III of FIG. 2.

Referring to FIGS. 1 through 3 again, in assembly of the lens-cleaning device 100, the lenses 200 are located in the grooves 11 of the tray 10, correspondingly, and the front cover 20 covers the tray 10 with each of the protrusions 22 located in the corresponding locating hole 13. Each of the air nozzles 30 is received in one corresponding assembling hole 21.

In use, the air nozzles 30 blow air against the outer surface of the lenses 200 at the same time, and the dust deposited on the outer surface of the lens 200 is blown away via the through holes 12.

The lens-cleaning device 100 includes a plurality of air nozzles 30, and the air nozzles 30 can blow air against the lenses 200 to clean the outer surface of the lenses 200 simultaneously. The cleaning efficiency of the lenses 200 is improved, and the dust removed from one lens 200 will not contaminate another lens 200.

It is believed that the present embodiments and their advantages will be understood from the foregoing description, and it will be apparent that various changes may be made thereto without departing from the spirit and scope of the embodiments or sacrificing all of its material advantages.

What is claimed is:

1. A lens-cleaning device for removing dust deposited on a plurality of lenses, comprising:

a tray defining a plurality of grooves and a plurality of through holes alternately arranged in a first surface of the tray, the grooves being apart from the through holes, each of the through holes located between two adjacent grooves, and each of the lenses received in a corresponding one of the plurality of grooves;

a front cover defining a plurality of assembling holes in a second surface of the front cover corresponding to the plurality of through holes; and a plurality of air nozzles received in the assembling holes, respectively, wherein the front cover covers the tray, and the air nozzles are capable of blowing air against the lenses causing the dust deposited on outer surfaces of the lenses to be blown away via the through holes, wherein the front cover further defines a plurality of inspection holes in the second surface corresponding to the grooves, and each of the lenses received in the corresponding one of the grooves is capable of being seen from one corresponding inspection hole.

2. The lens-cleaning device of claim 1, wherein the second surface of the front cover is opposite to the first surface of the tray.

3. The lens-cleaning device of claim 1, wherein the tray further defines at least two locating holes at two corners of the first surface, the front cover comprises at least two protrusions extending from two corners of the second surface, and each of the at least two protrusions is located in one corresponding locating hole to fasten the front cover to the tray.

4. The lens-cleaning device of claim 1, wherein each of the air nozzles defines a gas outlet in a side wall thereof, and the air nozzle blows air against the outer surface of the lens through the gas outlet.

5. The lens-cleaning device of claim 1, wherein the grooves are arranged in a matrix.

6. The lens-cleaning device of claim 1, wherein each of the air nozzles axially defines a gas outlet at an end of the air nozzle toward the tray, and the air nozzle blows air against the outer surface of the lens through the gas outlet.

7. A lens-cleaning device for removing dust deposited on a plurality of lenses, comprising:

a tray including a first surface, wherein the tray defines a plurality of grooves at the first surface, and each of the lenses is received in a corresponding one of the plurality of grooves;

a front cover including a second surface opposite to the first surface of the tray, wherein the front cover defines a plurality of assembling holes at the second surface and a plurality of inspection holes in the second surface corresponding to the grooves, and each of the lenses received in one groove is capable of being seen from one corresponding inspection hole; and a plurality of air nozzles received in the assembling holes, respectively, wherein the front cover covers the tray, and the air nozzles are capable of blowing air against the lenses causing the dust deposited on outer surfaces of the lenses to be blown away.

8. The lens-cleaning device of claim 7, wherein the tray further defines at least two locating holes at two corners of the first surface, the front cover comprises at least two protrusions extending from two corners of the second surface, and each of the at least two protrusions is located in one corresponding locating hole to fasten the front cover to the tray.

9. The lens-cleaning device of claim 7, wherein each of the air nozzles defines a gas outlet in a side wall thereof, and the air nozzle blows air against the outer surface of the lens through the gas outlet.

10. The lens-cleaning device of claim 7, wherein the grooves are arranged in a matrix.

11. The lens-cleaning device of claim 7, wherein each of the air nozzles axially defines a gas outlet at an end of the air nozzle toward the tray, and the air nozzle blows air against the outer surface of the lens through the gas outlet.

12. The lens-cleaning device of claim 7, wherein the tray further defines a plurality of through holes arranged between the plurality of grooves, and the air nozzles blow air against the lenses causing the dust deposited on the outer surfaces of the lenses to be blown away via the through holes.

13. A lens-cleaning device for removing dust deposited on a plurality of lenses, comprising:

a tray defining a plurality of grooves and a plurality of through holes alternately arranged in a first surface of the tray, and each of the lenses received in a corresponding one of the plurality of grooves;

a front cover defining a plurality of assembling holes in a second surface of the front cover corresponding to the plurality of through holes and a plurality of inspection holes in the second surface corresponding to the grooves, and each of the lenses received in the corresponding one of the grooves is capable of being seen from one corresponding inspection hole; and a plurality of air nozzles received in the assembling holes, respectively, wherein the front cover covers the tray, and the air nozzles are capable of blowing air against the lenses causing the dust deposited on the outer surface of the lenses to be blown away via the through holes.

14. The lens-cleaning device of claim 13, wherein the second surface of the front cover is opposite to the first surface of the tray.

15. The lens-cleaning device of claim 13, wherein the tray further defines at least two locating holes at two corners of the first surface, the front cover comprises at least two protrusions extending from two corners of the second surface, and each of the at least two protrusions is located in one corresponding locating hole to fasten the front cover to the tray.

16. The lens-cleaning device of claim 13, wherein each of the air nozzles defines a gas outlet in a side wall thereof, and the air nozzle blows air against the outer surface of the lens through the gas outlet.

17. The lens-cleaning device of claim 13, wherein the grooves are arranged in a matrix.

18. The lens-cleaning device of claim 13, wherein each of the air nozzles axially defines a gas outlet at an end of the air nozzle toward the tray, and the air nozzle blows air against the outer surface of the lens through the gas outlet.

* * * * *